US008091200B2

(12) United States Patent
Kobayashi et al.

(10) Patent No.: US 8,091,200 B2
(45) Date of Patent: Jan. 10, 2012

(54) BULGE FORMING METHOD AND BULGE FORMING APPARATUS

(75) Inventors: Takuo Kobayashi, Tochigi (JP); Izuru Hori, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 462 days.

(21) Appl. No.: 12/402,207

(22) Filed: Mar. 11, 2009

(65) Prior Publication Data

US 2009/0229102 A1 Sep. 17, 2009

(30) Foreign Application Priority Data

Mar. 12, 2008 (JP) ..... 2008-062263
Mar. 12, 2008 (JP) ..... 2008-062277

(51) Int. Cl.
*B23P 17/00* (2006.01)
*B21D 15/03* (2006.01)
*B21D 26/02* (2011.01)
*B21J 5/04* (2006.01)

(52) U.S. Cl. ..... 29/421.1; 29/454; 72/56; 72/58; 72/59

(58) Field of Classification Search ..... 29/888.3, 29/421.1, 454; 72/56, 58, 59, 61, 63, 370.2, 72/370.21, 370.22
See application file for complete search history.

(56) References Cited

U.S. PATENT DOCUMENTS

| | | | | |
|---|---|---|---|---|
| 3,625,040 | A * | 12/1971 | DeGain | 72/59 |
| 3,704,983 | A | 12/1972 | Tellot | |
| 5,054,182 | A | 10/1991 | Riemscheid et al. | |
| 6,089,064 | A * | 7/2000 | Tauzer | 72/62 |
| 6,820,317 | B2 * | 11/2004 | Okada | 29/421.1 |
| 2002/0046586 | A1 * | 4/2002 | Singer et al. | 72/58 |

FOREIGN PATENT DOCUMENTS

| | | | |
|---|---|---|---|
| DE | 1777181 | A1 | 3/1971 |
| DE | 2118207 | A1 | 10/1972 |
| DE | 36 43 803 | A1 | 4/2010 |
| JP | 2001-321841 | A | 11/2001 |

* cited by examiner

*Primary Examiner* — Jermie Cozart
(74) *Attorney, Agent, or Firm* — Arent Fox, LLP

(57) ABSTRACT

A bulge forming method includes arranging a raw material tube inside a die having an inner surface shape, in which plural crest portions and root portions are alternately formed, and providing a rod inside the raw material tube in the axial direction of the raw material tube, and the rod has a pressurized liquid supply opening. The bulge forming method further includes providing a pair of sealing portion having the pressurized liquid supply opening therebetween, and the sealing portions seal a space between the raw material tube and the rod. The bulge forming method further includes moving the rod in the axial direction while applying compressive stress to the raw material tube in the axial direction and supplying a pressurized liquid from the pressurized liquid supply opening into the raw material tube, whereby the raw material tube is formed into the shape of the inner surface of the die.

8 Claims, 6 Drawing Sheets

Fig. 7 "Prior Art"
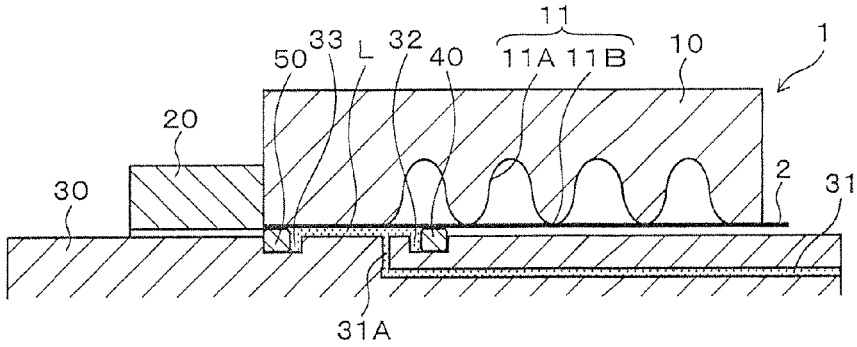
Fig. 8A "Prior Art"
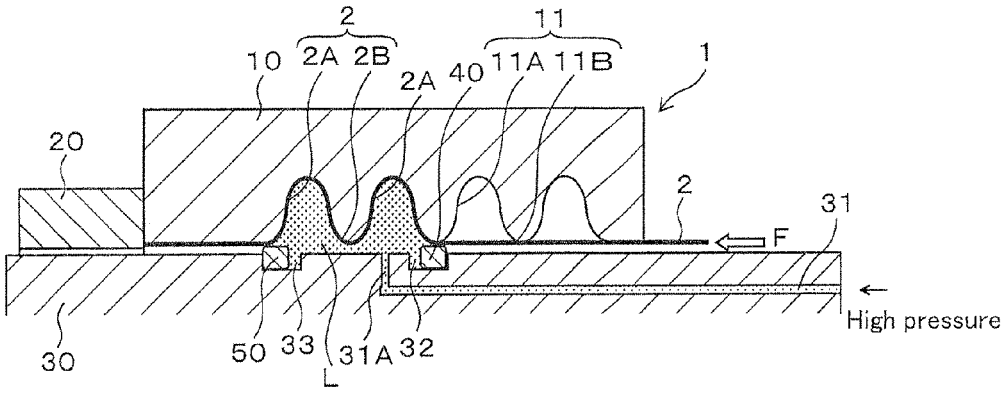
Fig. 8B "Prior Art"
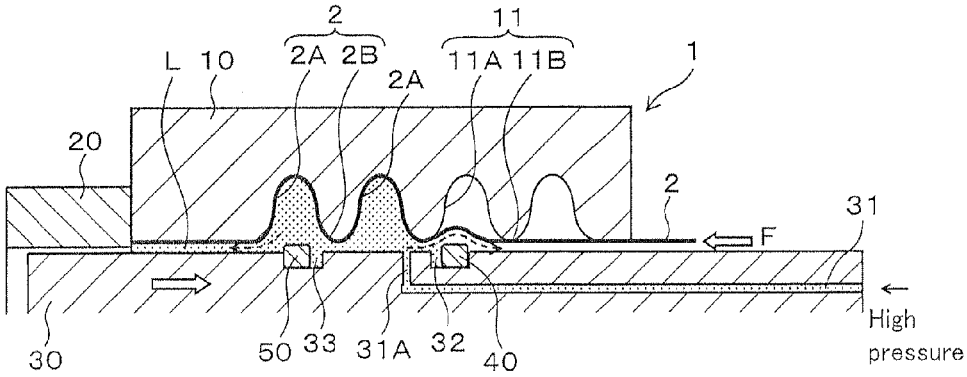

Fig. 9A "Prior Art"
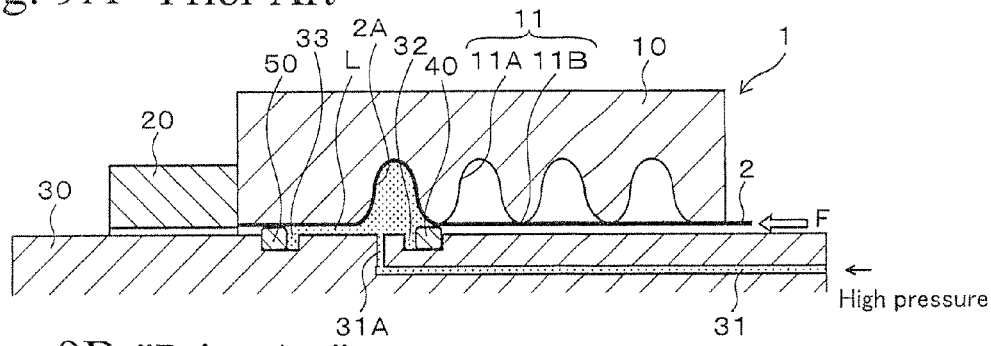
Fig. 9B "Prior Art"
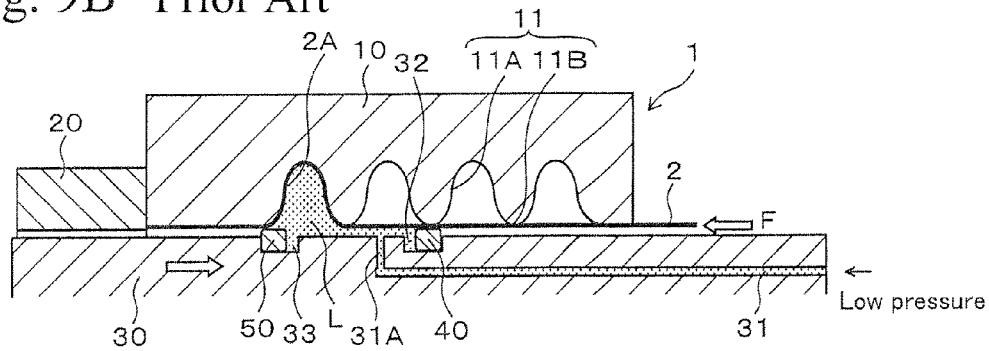
Fig. 9C "Prior Art"
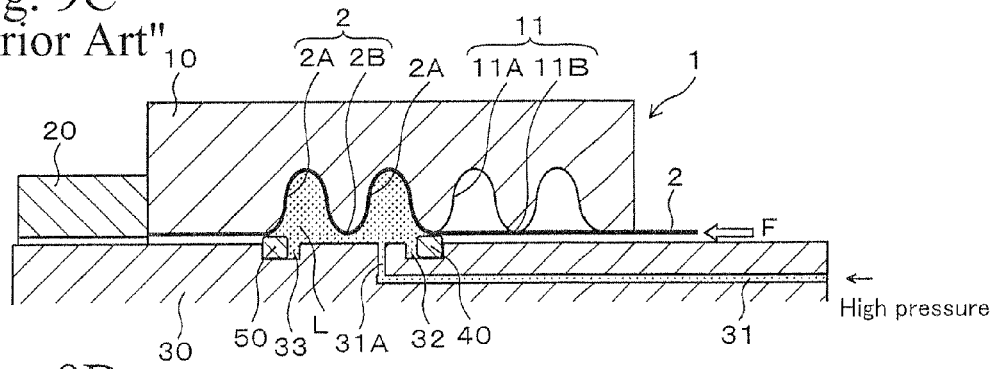
Fig. 9D "Prior Art"
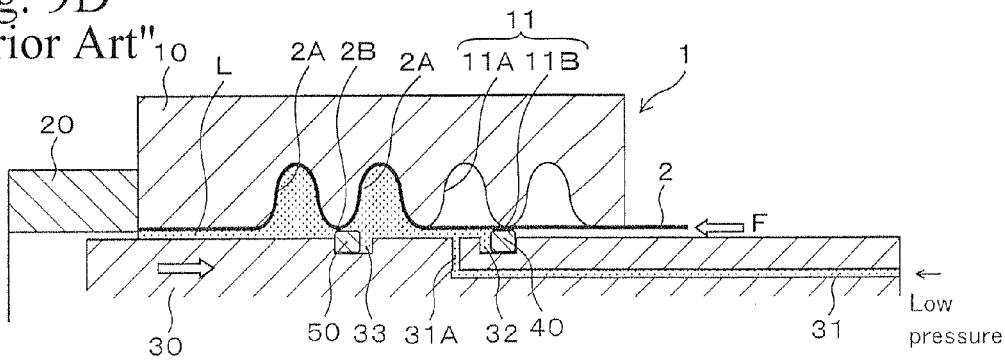

BULGE FORMING METHOD AND BULGE FORMING APPARATUS

BACKGROUND OF THE INVENTION

1. Technical Field

The present invention relates to a bulge forming method and to a bulge forming apparatus therefor, in which a raw material tube arranged between a die and a rod is formed into a shape of an inner surface of the die. The raw material tube is formed by moving the rod in the axial direction of the raw material tube while compressive stress is applied to the raw material tube and a pressurized liquid is supplied into the raw material tube. In particular, the present invention relates to improvements in sealing portions for sealing a space between the raw material tube and the rod.

2. Background Art

Bulge forming methods are used for forming shapes of containers, worked tubes, hollow structural parts of automobiles and various machines, etc. In the bulge forming method, a raw material tube is expanded by partially bulging without decreasing the wall thickness thereof, and the raw material tube is thereby formed into a predetermined shape. As a bulge formed tube obtained by this method, flexible tubes, bellows tubes, and expandable tubes, may be mentioned. The flexible tube has bellows with plural bulged portions that are flexibly bendable, the bellows tube has a larger surface area than that of an ordinary tube and is used for releasing heat, and the expandable tube has bellows portions that have the elastic characteristics of a spring.

In the bulge forming method, for example, a bulge forming apparatus 1 shown in FIG. 7 may be used (for example, see Japanese Patent Application Laid-Open No. 2001-321841). FIG. 7 is a sectional side view showing a schematic structure of a bulge forming apparatus 1 and shows a structure of an upper half portion of the bulge forming apparatus 1. In order to simplify the figures, a position of a right end of a raw material tube 2 with respect to a die 10 is the same in all of the figures. The bulge forming apparatus 1 is provided with a die 10 formed so that the raw material tube 2 is arranged inside thereof, and an abutting die 20 for abutting a left end portion of the raw material tube 2. Each of the die 10 and the abutting die 20 is made up of a pair of an upper die and a lower die. The die 10 and the abutting die 20 are fixed by fixing devices (not shown in the figure) for preventing the opening of the die 10 and the abutting die 20.

The die 10 has an inner surface having a bellows shape 11 in which plural crest portions 11A and root portions 11B are alternately formed. The crest portions 11A and the root portions 11B are, for example, periodically formed and have axially symmetrical shapes. A rod 30 is provided inside the raw material tube 2 so as to be movable along the axial direction of the raw material tube 2. A pressurized liquid supply path 31 is formed inside the rod 30 so that a pressurized liquid L is supplied therefrom through a pressurized liquid supply opening 31A to a space between the raw material tube 2 and the rod 30.

The rod 30 has a surface in the circumferential direction, on which a pair of grooves 32 and 33 is formed having the pressurized liquid supply opening 31A therebetween. The grooves 32 and 33 are mounted with ring-shaped sealing portions 40 and 50, respectively, and the sealing portions 40 and 50 seal the space between the raw material tube 20 and the rod 30. The sealing portion 50 is in the posterior side of the forming direction, and a pressurized liquid collecting path (not shown in the figure) for collecting a pressurized liquid L that has been used in forming is formed at the left of the sealing portion 50 of the rod 30A. The collected pressurized liquid L is supplied to the pressurized liquid supply path 31 and is reused. The rod 30 has a right end portion provided with a moving device (not shown in the figure) for moving the rod 30 to the right in the axial direction (in the forming direction). A raw material tube pressing device (not shown in the figure) for applying compressive stress F to the raw material tube 2 toward the abutting die 20 is formed at the right side of the die 10.

In the bulge forming apparatus 1, the left end portion of the raw material tube 2 is butted with the abutting die 20. Then, a pressurized liquid L is supplied to the space between the raw material tube 2 and the rod 30 from the pressurized liquid supply opening 31A, while compressive stress F is applied to the raw material tube 2 from the right end portion thereof to the left in the axial direction (to the posterior side of the forming direction). The pressurized liquid L is set at high pressure so that the raw material tube 2 is deformable according to the crest portions 11A of the bellows shape 11 of the die 10, and the sealing portions 40 and 50 seal the space between the raw material tube 2 and the rod 30. In this condition, the rod 30 is moved to the right in the axial direction, whereby the raw material tube 2 is bulged each time the pressurized liquid L is supplied to a space corresponding to a crest portion 11A of the die 10. The raw material tube 2 is bulged according to the shape of the crest portion 11A by the pressurized liquid L at high pressure. Thus, crest portions 2A and root portions 2B are formed at the raw material tube 2 one by one, in order, from the left side, whereby the raw material tube 2 is expanded into the shape corresponding to the bellows shape 11 of the die 10.

In the tube expansion performed by the bulge forming apparatus 1, the pressurized liquid L is set at high pressure in order to bulge the raw material tube. Therefore, the following problems occur in the sealing conditions of the sealing portions 40 and 50 each time the pressurized liquid supply opening 31A is moved between crest portions 11A of the die 10 after a first crest portion 2A is formed.

In the tube expansion, for example, after crest portions 2A are formed at the raw material tube 2 as shown in FIG. 8A, in order to form a next crest portion (third crest portion), the rod 30 is moved in a direction of a wide arrow in FIG. 8B in a condition in which the pressurized liquid L is maintained at high pressure as shown in FIG. 8B. In this case, the sealing portion 40 is in the anterior side of the forming direction and passes the third crest portion 11A having a large space between the die 10 and the rod 30. At that time, the raw material tube 2 bulges according to the shape of the third crest portion 11A, and therefore, pressing power is not sufficiently applied from the die 10 to the sealing portion 40. As a result, the sealing condition of the sealing portion 40 becomes inferior, and the pressurized liquid L may leak from the sealing portion 40 to the outside in the right side. Therefore, the liquid pressure must be increased in order to maintain the pressurized liquid L at high pressure, thereby causing wasting time.

On the other hand, when the sealing portion 50 passes the first crest portion 2A formed at the raw material tube 2 as shown in FIG. 8B, a large gap is formed between the sealing portion 50 and the first crest portion 2A, whereby the pressurized liquid L may leak from the gap to the outside in the left side. Therefore, the liquid pressure must be increased in order to maintain the pressurized liquid L at high pressure, thereby causing wasting time. The above problems in the sealing conditions of the sealing portions 40 and 50 occur each time the pressurized liquid supply opening 31A is moved between crest portions 11A of the die 10 after the first crest portion 2A is formed.

There may be a countermeasure for the problem in the sealing condition of the sealing portion 40. In this countermeasure, the liquid pressure of the pressurized liquid L is switched between high and low according to the positions of the sealing portions 40 and 50 with respect to the bellows shape 11 of the die 10.

For example, a first crest portion 2A is formed as shown in FIG. 9A. Then, the pressurized liquid L is set at low pressure so as not to deform the raw material tube 2 before the rod 30 is moved to the right in the axial direction (in the direction of a wide arrow in the figure) in order to form a next crest portion as shown in FIG. 9B. The pressurized liquid supply opening 31A is moved to the vicinity of a second crest portion 11A, and the sealing portion 40 is moved to a root portion 11B in the right side of the second crest portion 11A and is thereby maintained. Next, the movement of the rod 30 is stopped as shown in FIG. 9C, and the pressurized liquid L is set at high pressure, whereby a second crest portion 2A is formed at the raw material tube 2.

As shown in FIG. 9D, the same operation as in FIG. 9B is performed, and the liquid pressure of the pressurized liquid L is set low. The pressurized liquid supply opening 31A is moved to the vicinity of a third crest portion 11A, and the sealing portion 40 is moved to a root portion 11B in the right side of the third crest portion 11A and is thereby maintained. Such switching of the liquid pressure of the pressurized liquid L between high and low is performed each time a crest portion 2A is formed and the pressurized liquid supply opening 31A is moved between crest portions 11A. Accordingly, the problems due to the sealing condition of the sealing portion 40 do not occur.

The liquid pressure of the pressurized liquid L must be switched between high and low repeatedly in order to expand the raw material tube 2. Therefore, the switching of the liquid pressure takes time, and it is difficult to perform tube expansion at a high rate. Since the pressurized liquid L cannot be continuously maintained at high pressure, shape fixability of the raw material tube 2 with respect to the die 10 is decreased, whereby accuracy of the tube expansion is decreased, and variations among products may be increased. Specifically, in forming a bellows shape having plural crest portions 2A at the raw material tube 2, the decrease in the shape fixability has a large effect.

SUMMARY OF THE INVENTION

An object of the present invention is to provide a bulge forming method and a bulge forming apparatus therefor. In the bulge forming method and the bulge forming apparatus, leakage of a pressurized liquid can be prevented, and tube expansion is performed at a high rate and with high accuracy, thereby reducing variations among products.

According to a first aspect of the present invention, the present invention provides a bulge forming method including arranging a raw material tube inside a die having an inner surface shape in which plural crest portions and root portions are alternately formed. This bulge forming method further includes providing a rod inside the raw material tube in the axial direction of the raw material tube, and the rod has a pressurized liquid supply opening. This bulge forming method further includes providing a pair of sealing portions so as to have the pressurized liquid supply opening therebetween, and the sealing portions seal a space between the raw material tube and the rod. This bulge forming method further includes moving the rod in the axial direction while applying compressive stress to the raw material tube in the axial direction and supplying a pressurized liquid from the pressurized liquid supply opening into the raw material tube, whereby the raw material tube is formed into the shape of the inner surface of the die. The sealing portion in the anterior side of a forming direction is applied with liquid pressure of the pressurized liquid in a direction from the rod toward the raw material tube so as to be followable to bulging of the raw material tube. The distance between the sealing portions is set to have a length of at least two crest portions of the inner surface shape of the die, and a length in the axial direction of the sealing portion in the posterior side of the forming direction is set to have a length of at least one crest portion of the inner surface shape of the die.

In the bulge forming method of the first aspect of the present invention, the rod is moved in the axial direction while compressive stress is applied to the raw material tube in the axial direction and the pressurized liquid is supplied from the pressurized liquid supply opening into an area inside the raw material tube. The area is sealed by the pair of the sealing portions. Therefore, the raw material tube is bulged according to the shape of a crest portion by the pressurized liquid each time the pressurized liquid is supplied to a position corresponding to the crest portion of the die. Thus, crest portions and root portions are formed at the raw material tube one by one, in order, from the posterior side of the moving direction of the rod (from the posterior side of the forming direction), whereby the raw material tube is expanded into a shape corresponding to the inner surface shape of the die.

In the bulge forming method of the first aspect of the present invention, the pair of the sealing portions for sealing the space between the raw material tube and the rod closely contacts the raw material tube during formation as follows. After one crest portion is formed at the raw material tube, when the sealing portion in the anterior side of the forming direction passes a position corresponding to the next crest portion of the die, the raw material tube is bulged according to the shape of the next crest portion by the pressurized liquid. In this case, the sealing portion in the anterior side of the forming direction is applied with liquid pressure of the pressurized liquid in a direction from the rod toward the raw material tube, whereby the sealing portion is followable to bulging of the raw material tube. The shape and the elastic characteristics of this sealing portion, liquid pressure of the pressurized liquid, and the moving rate of the rod are appropriately set, so that one end portion of this sealing portion contacts the raw material tube while the other end portion thereof contacts the rod, when this sealing portion follows the raw material tube. Accordingly, at least one portion of the sealing portion in the anterior side of the forming direction continuously closely contacts the raw material tube. As a result, even when the pressurized liquid is continuously set at high pressure during formation of the raw material tube, leakage of the pressurized liquid to the outside in the anterior side of the forming direction is prevented.

The distance between the sealing portions is set to have a length of at least two crest portions of the inner surface shape of the die, and the length in the axial direction of the sealing portion in the posterior side of the forming direction is set to have a length of at least one crest portion of the inner surface shape of the die. Therefore, by appropriately setting the shape and the elastic characteristics of the sealing portion in the posterior side of the forming direction, this sealing portion continuously closely contacts any of the flat portion of the raw material tube and root portions formed at the raw material tube. As a result, even when the pressurized liquid is continuously set at high pressure during the formation of the raw material tube, leakage of the pressurized liquid to the outside in the posterior side of the forming direction is prevented. The distance between the sealing portions has a length of two crest portions, which is the total length of a crest portion to be formed and a crest portion in the posterior side of the forming direction. The crest portion in the posterior side of the forming direction is set for preventing the raw material tube from buckling due to the compressive stress applied to the raw material tube.

As described above, in the bulge forming method of the first aspect of the present invention, even when the pressurized liquid is continuously set at high pressure during formation of the raw material tube, leakages of the pressurized liquid to the outsides are prevented. Therefore, supplying for a deficiency in the liquid pressure and switching of the liquid pressure between high and low are not necessary, whereby the raw material tube can be formed at high pressure and at a high rate. Since the pressurized liquid is continuously maintained at high pressure, the shape fixability of the raw material tube with respect to the die is improved, whereby accuracy of the tube expansion is improved, and variations among products are reduced. The pressurized liquid is not supplied to all areas between the raw material tube and the rod, which corresponds to the inner surface shape of the die, but is supplied only to an area between the raw material tube and the rod that is sealed by the pair of the sealing portions. Accordingly, a fixing device for fixing the die can be reduced in size, whereby the apparatus cost is reduced. Such a bulge forming method is preferably used for a thin-walled raw material tube.

In the bulge forming method of the first aspect of the present invention, various structures may be used. For example, when the pressurized liquid supply opening reaches a position corresponding to the midportion of a crest portion of the die, movement of the rod may be intermittent, and the raw material tube may be formed into the shape of the crest portion of the die, which is immediately above the pressurized liquid supply opening. In this case, even when the raw material tube has a large wall thickness, the raw material tube is reliably formed according to the inner surface shape of the die.

The bulge forming method of the first aspect of the present invention may be used for a bulge forming apparatus. That is, according to the first aspect of the present invention, the present invention provides a bulge forming apparatus including a die having an inner surface shape, in which plural crest portions and root portions are alternately formed, and the die is formed so that a raw material tube is arranged inside thereof. This bulge forming apparatus further includes a rod provided inside the raw material tube along the axial direction of the raw material tube and having a pressurized liquid supply opening. This bulge forming apparatus further includes a pair of sealing portions provided so as to have the pressurized liquid supply opening therebetween and sealing a space between the raw material tube and the rod. The rod is moved in the axial direction while compressive stress is applied to the raw material tube in the axial direction and a pressurized liquid is supplied from the pressurized liquid supply opening into the raw material tube, whereby the raw material tube is formed into the shape of the inner surface of the die. The rod is provided with a liquid pressure applying path for applying liquid pressure of the pressurized liquid to the sealing portion in the anterior side of a forming direction, in a direction from the rod toward the raw material tube. The sealing portion in the anterior side of the forming direction is followable to bulging of the raw material tube by the liquid pressure of the pressurized liquid applied through the liquid pressure applying path. The distance between the sealing portions is set to have a length of at least two crest portions of the inner surface shape of the die. The length in the axial direction of the sealing portion in the posterior side of the forming direction is set to have a length of at least one crest portion of the inner surface shape of the die. In the bulge forming apparatus of the first aspect of the present invention, the same function and effects as those of the bulge forming method of the first aspect of the present invention are obtained.

In the bulge forming apparatus of the first aspect of the present invention, various structures may be used. For example, when the pressurized liquid supply opening reaches a position corresponding to the midportion of a crest portion of the die, movement of the rod may be intermittent, and the raw material tube may be formed into the shape of the crest portion of the die, which is immediately above the pressurized liquid supply opening. In this case, the same function and effects as those of the structure of the bulge forming method of the first aspect of the present invention are obtained.

According to a second aspect of the present invention, the present invention provides a bulge forming method including arranging a raw material tube inside a die having an inner surface shape in which plural crest portions and root portions are alternately formed. This bulge forming method further includes forming a rod so as to have a guide rod and a hollow rod, the guide rod is fixed to the die and has a pressurized liquid supply opening, and the hollow rod is movably arranged around the guide rod. This bulge forming method further includes providing the rod inside the raw material tube and providing a pair of a first sealing portion and a second sealing portion so as to have the pressurized liquid supply opening therebetween, and the first and the second sealing portions seal a space between the raw material tube and the rod. The first sealing portion is arranged so that the guide rod guides the first sealing portion along the axial direction of the raw material tube, and the second sealing portion is secured to the guide rod. This bulge forming method further includes moving the hollow rod in the axial direction while applying compressive stress to the raw material tube in the axial direction and supplying a pressurized liquid from the pressurized liquid supply opening into the raw material tube, whereby the raw material tube is formed into the shape of the inner surface of the die. The hollow rod has an end portion in the posterior side of the forming direction, and the first sealing portion is pressed toward the end portion by liquid pressure of the pressurized liquid and is elastically deformed so as to be followable to bulging of the raw material tube in the formation of the raw material tube. The position of the second sealing portion is controlled by the movement the hollow rod.

In the bulge forming method of the second aspect of the present invention, the hollow rod is moved in the axial direction while compressive stress is applied to the raw material tube in the axial direction thereof and the pressurized liquid is supplied from the pressurized liquid supply opening of the guide rod into an area inside the raw material tube. The area is sealed by the pair of the sealing portions. Therefore, the raw material tube is bulged according to the shape of a crest portion by the pressurized liquid each time the pressurized liquid is supplied to a position corresponding to the crest portion of the die. Thus, crest portions and root portions are formed at the raw material tube one by one, in order, from the posterior side of the moving direction of the hollow rod (from the posterior side of the forming direction), whereby the raw material tube is expanded into a shape corresponding to the inner surface shape of the die.

In the bulge forming method of the second aspect of the present invention, the pair of the sealing portions sealing the space between the raw material tube and the rod closely contact the raw material tube as follows. The first sealing portion is in the anterior side of a forming direction and is pressed toward the end portion in the posterior side of the forming direction of the hollow rod by the liquid pressure of the pressurized liquid supplied to the space between the raw material tube and the rod. Therefore, the first sealing portion is elastically deformed by the pressing power of the pressurized liquid, thereby being followable to the bulging of the raw material tube. Accordingly, by appropriately setting the shape and the elastic characteristics of the first sealing portion, the liquid pressure of the pressurized liquid, etc., at least a portion of the first sealing portion continuously closely contacts the raw material tube.

The position of the first sealing portion is controlled by the movement of the hollow rod, and the moving rate of the hollow rod can be controlled so as to be not less than bulging rate of the raw material tube. Therefore, the first sealing portion is continuously moved to a start position of bulging of the raw material tube and to a position anterior to the start position in the forming direction. Accordingly, the first sealing portion is pressed at the end portion in the posterior side of the forming direction of the rod by the liquid pressure of the above pressurized liquid, whereby the amount of elastic deformation is great. Thus, the first sealing portion easily follows the bulging of the raw material tube, and the contacting condition of at least a portion of the first sealing portion with respect to the raw material tube is further improved. As a result, even when the pressurized liquid is continuously set at high pressure during the formation of the raw material tube, leakage of the pressurized liquid to the outside in the anterior side of the forming direction is prevented.

The second sealing portion is in the posterior side of the forming direction and is secured to the guide rod, whereby the position and the shape of the second sealing portion are not changed, and the second sealing portion is positioned at a flat portion of the raw material tube. Therefore, by appropriately setting the shape and the elastic characteristics of the second sealing portion, the second sealing portion continuously closely contacts the flat portion of the raw material tube. As result, even when the pressurized liquid is continuously set at high pressure during formation of the raw material tube, leakage of the pressurized liquid to the outside in the posterior side of the forming direction is prevented.

As described above, in the bulge forming method of the second aspect of the present invention, even when the pressurized liquid is continuously set at high pressure during the formation of the raw material tube, leakages of the pressurized liquid to the outsides are prevented. Accordingly, supplying for a deficiency in the liquid pressure and switching of the liquid pressure between high and low are not necessary, whereby the forming of the raw material tube can be performed at high pressure and at a high rate. Since the pressurized liquid is continuously maintained at high pressure, the shape fixability of the raw material tube with respect to the die is improved, whereby accuracy of the tube expansion is improved, and variations among products are reduced.

The hollow rod that moves in forming of the raw material tube receives the liquid pressure only from the end portion in the posterior side of the forming direction via the first sealing portion. Therefore, compared to a conventional case in which the entirety of the outer circumferential surface of a rod receives liquid pressure, the hollow rod receives a low level of liquid pressure. Accordingly, the amount of power required for controlling the position of the hollow rod can be small, whereby a moving device for the hollow rod may be reduced in size. Since the pressurized liquid supply opening is formed at the guide rod fixed to the die, a pressurized liquid supply path to the pressurized liquid supply opening can be formed at the guide rod. Therefore, compared to a conventional case of forming a pressurized liquid supply path at a rod that moves in the forming of a raw material tube, the pressurized liquid supply path is simply constructed. According to the above descriptions, the apparatus cost is decreased.

In the bulge forming method of the second aspect of the present invention, various structures may be used. For example, the guide rod may have a large diameter portion and a small diameter portion that is connected to the large diameter portion and has a smaller diameter than the diameter of the large diameter portion. The second sealing portion may be secured to the large diameter portion, and the small diameter portion may guide the first sealing portion in the axial direction of the raw material tube. The hollow rod may be movably arranged around the small diameter portion, and the pressurized liquid supply opening may be formed at the large diameter portion. In this case, the pressurized liquid supply opening is formed at the large diameter portion of the guide rod, whereby the first sealing portion can be made to abut an end portion of the large diameter portion, which is in the side of the small diameter portion, at the start of forming of the raw material tube. Therefore, the initial position of the first sealing portion is easily set at the start of forming of the raw material tube.

The bulge forming method of the second aspect of the present invention may be used for a bulge forming apparatus. That is, according to the second aspect of the present invention, the present invention provides a bulge forming apparatus including a die having an inner surface shape, in which plural crest portions and root portions are alternately formed, and the die is formed so that a raw material tube is arranged inside thereof. This bulge forming apparatus further includes a rod provided inside the raw material tube and includes a pair of a first sealing portion and a second sealing portion provided so as to have a pressurized liquid supply opening therebetween, and the first and the second sealing portion seal a space between the raw material tube and the rod. The rod has a guide rod and a hollow rod, the guide rod is fixed to the die and has the pressurized liquid supply opening, and the hollow rod is movably arranged around the guide rod. The first sealing portion is arranged so that the guide rod guides the first sealing portion along the axial direction of the raw material tube, and the second sealing portion is secured to the guide rod. The hollow rod is moved in the axial direction while compressive stress is applied to the raw material tube in the axial direction of the raw material tube and a pressurized liquid is supplied from the pressurized liquid supply opening into the raw material tube, whereby the raw material tube is formed into the shape of the inner surface of the die. The hollow rod has an end portion in the posterior side of the forming direction, and the first sealing portion is pressed toward the end portion by liquid pressure of the pressurized liquid and is elastically deformed so as to be followable to bulging of the raw material tube in forming of the raw material tube. The position of the first sealing portion is controlled by the movement of the hollow rod. In the bulge forming apparatus of the second aspect of the present invention, the same function and effects as those of the bulge forming method of the second aspect of the present invention are obtained.

In the bulge forming apparatus of the second aspect of the present invention, various structures may be used. For example, the guide rod may have a large diameter portion and a small diameter portion that is connected to the large diameter portion and has a smaller diameter than the diameter of the large diameter portion. The second sealing portion may be secured to the large diameter portion, and the small diameter portion may guide the first sealing portion in the axial direction of the raw material tube. The hollow rod may be movably arranged around the small diameter portion, and the pressurized liquid supply opening may be formed at the large diameter portion. In this case, the same function and effects as those of the bulge forming method of the second aspect of the present invention are obtained.

According to the bulge forming methods and the bulge forming apparatuses of the present invention, even when the pressurized liquid is continuously set at high pressure during formation of the raw material tube, leakage of the pressurized liquid to the outside is prevented. Therefore, supplying for a deficiency in the liquid pressure and switching of the liquid pressure between high and low are not necessary, whereby the raw material tube is formed at high pressure and at a high rate. Since the pressurized liquid is continuously maintained at high pressure, the shape fixability of the raw material tube with respect to the die is improved, whereby accuracy of the tube expansion is improved, and variations among products are reduced.

BRIEF DESCRIPTION OF THE DRAWINGS

FIG. 2A is a sectional side view showing a schematic structure of the bulge forming apparatus in forming a third crest portion at a raw material tube. FIG. 2B is a sectional side view showing a schematic structure of the bulge forming apparatus immediately after the third crest portion is formed at the raw material tube. FIG. 2C is a sectional side view showing a schematic structure of the bulge forming apparatus in forming a fourth crest portion at the raw material tube.

FIG. 7 is a sectional side view showing a schematic structure of a conventional bulge forming apparatus.

FIGS. 8A and 8B show steps in a bulge forming method using the bulge forming apparatus shown in FIG. 7. FIG. 8A is a sectional side view showing a schematic structure of the bulge forming apparatus immediately after a second crest portion is formed at a raw material tube, and FIG. 8B is a sectional side view showing a schematic structure of the bulge forming apparatus while a rod is moved for forming a third crest portion.

FIGS. 9A to 9D show steps in another bulge forming method using the bulge forming apparatus shown in FIG. 7. FIG. 9A is a sectional side view showing a schematic structure of the bulge forming apparatus immediately after a first crest portion is formed at a raw material tube, and FIG. 9B is a sectional side view showing a schematic structure of the bulge forming apparatus before a second crest portion is formed at the raw material tube. FIG. 9C is a sectional side view showing a schematic structure of the bulge forming apparatus immediately after the second crest portion is formed at the raw material tube, and FIG. 9D is a sectional side view showing a schematic structure of the bulge forming apparatus before a third crest portion is formed at the raw material tube.

PREFERRED EMBODIMENTS OF THE INVENTION

(A) First Embodiment (1) Structure of First Embodiment

Figure 1:
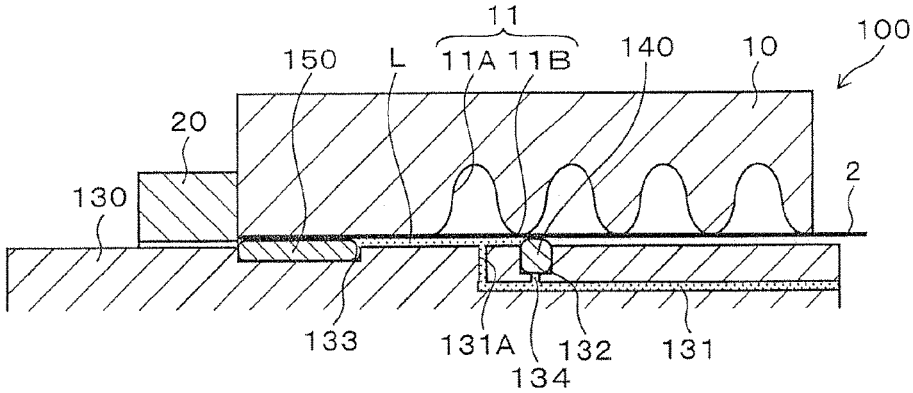
FIG. 1 is a sectional side view showing a schematic structure of a bulge forming apparatus relating to a first embodiment of the present invention.

A first embodiment of the present invention is described with reference to the drawings hereinafter. FIG. 1 is a sectional side view showing a schematic structure of a bulge forming apparatus 100 relating to the first embodiment of the present invention. FIG. 1 shows a structure of an upper half portion of the bulge forming apparatus 100. In this embodiment, structural portions similar to those in FIG. 7 are indicated by the same reference numerals as those in FIG. 7, and descriptions therefor are omitted.

A pressurized liquid supply path 131 is formed inside a rod 130, and a pressurized liquid L is supplied from the pressurized liquid supply path 131 through a pressurized liquid supply opening 131A to a space between the raw material tube 2 and the rod 130. A pair of grooves 132 and 133 is formed on the circumferential surface of the rod 130 so as to have the pressurized liquid supply opening 131A therebetween. The grooves 132 and 133 are arranged with ring-shaped sealing portions 140 and 150 for sealing the space between the raw material tube 2 and the rod 130, respectively. In this embodiment, since the rod 130 is moved to the right in forming of the raw material tube 2, the sealing portion 140 corresponds to a sealing portion in the anterior side of the forming direction of the present invention, and the sealing portion 150 corresponds to a sealing portion in the posterior side of the forming direction of the present invention.

The sealing portions 140 and 150 are elastic, for example. The sealing portion 140 contacts the entire circumferences of the right side and the left side of the inner surface of the groove 132, thereby sealing the groove 132. The distance between the sealing portion 140 and the pressurized liquid supply opening 131A is preferably set to be half the length of a crest portion. In this case, when the sealing portion 140 passes a position corresponding to a root portion 11B of the die 10, the pressurized liquid supply opening 131A reaches a position corresponding to the midportion of a crest portion 11A of the die 10. The distance between the sealing portions 140 and 150 is set to have a length of two crest portions of the bellows shape 11 of the die 10, for example. The length in the axial direction of the sealing portion 150 is set to have a length of one crest portion of the bellows shape 11 of the die 10. In this case, by appropriately setting the shape and the elastic characteristics of the sealing portion 150, the sealing portion 150 continuously closely contacts any of the flat portion of the raw material tube and root portions formed at the raw material tube during formation of the raw material tube 2. If the distances between crest portions 11A and 11A are not equal, the distance between the sealing portions 140 and 150 is set to have a length of two crest portions, which is the greatest total length of two crest portions adjacent to each other, and the length in the axial direction of the sealing portion 150 is set to have a length of one crest portion, which is the greatest length of one of the crest portions.

A liquid pressure applying path 134 is formed inside the rod 130 for connecting the pressurized liquid supply path 131 and the groove 132. Liquid pressure of the pressurized liquid L is applied to the sealing portion 140 in a direction from the rod 130 toward the raw material tube 2 through the liquid pressure applying path 134. Accordingly, the sealing portion 140 is followable to bulging of the raw material tube in forming of the raw material tube. In this case, the shape and the elastic characteristics of the sealing portion 140, the liquid pressure of the pressurized liquid L, and the moving rate of the rod 130 are appropriately set so that an upper end portion of the sealing portion 140 contacts the raw material tube 2 while a lower end portion of the sealing portion 140 contacts the rod 130. Therefore, at least a portion of the sealing portion 140 continuously closely contacts the raw material tube 2.

(2) Operation of First Embodiment

Figure 2A:
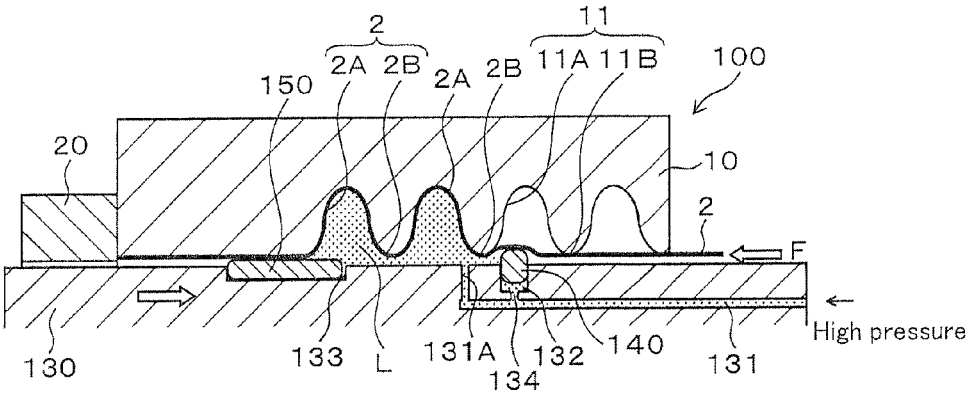
FIGS. 2A to 2C show steps in a bulge forming method using the bulge forming apparatus shown in FIG. 1.
Figure 2B:
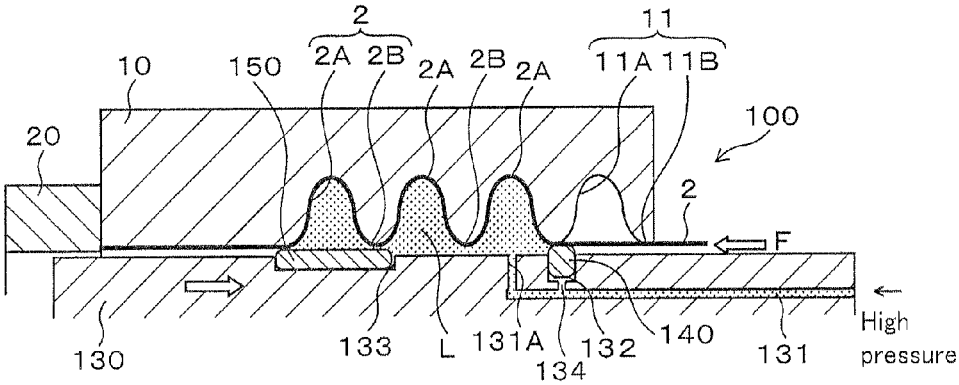
Figure 2C:
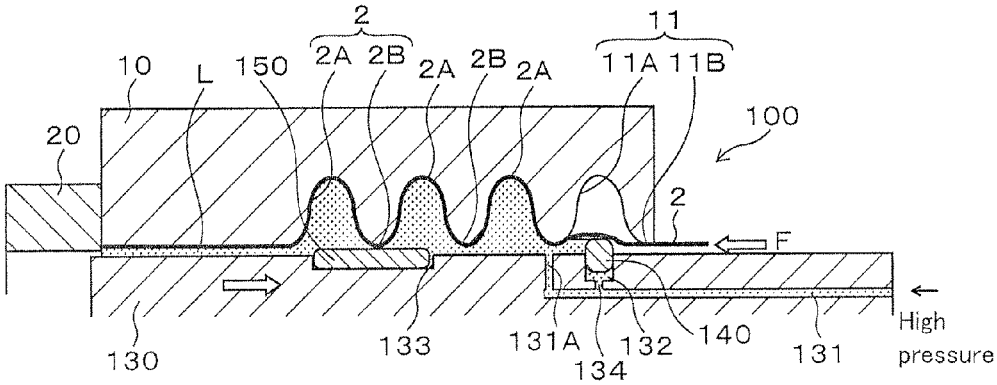

A bulge forming method using the bulge forming apparatus 100 is described with reference to the drawings. FIGS. 2A to 2C show arrows in the rod 130, and the arrows indicate a moving direction of the rod 130.

As shown in FIG. 1, a left end portion of the raw material tube 2 is butted with the abutting die 20, and the pressurized liquid L is supplied to an area from the pressurized liquid supply opening 131A into the raw material tube 2 while compressive stress F is applied from a right end portion of the raw material tube 2 toward the left in the axial direction. The area is sealed by the pair of the sealing portions 140 and 150. In this condition, by moving the rod 130 to the right in the axial direction (in the forming direction), the raw material tube 2 is bulged according to the shape of a crest portion 11A by the pressurized liquid L each time the pressurized liquid supply opening 131A reaches a position corresponding to the crest portion 11A of the die 10. Thus, crest portions 11A and root portions 11B are formed at the raw material tube 2 one by one, in order, from the posterior side of the moving direction (forming direction) of the rod 130, whereby the raw material tube 2 is expanded into a shape corresponding to the inner surface shape of the die 10.

In such tube expansion, the sealing portions 140 and 150 sealing the space between the raw material tube 2 and the rod 130 closely contact the raw material tube 2 not only during formation of crest portions 2A of the raw material tube 2 but also during movement between the crest portion 2A and the next crest portion 11A of the die 10. For example, as shown in FIG. 2A, when the sealing portion 140 passes a position corresponding to a third crest portion 11A of the die 10 after a second crest portion 2A of the raw material tube 2 is formed, the raw material tube 2 is bulged according to the shape of the third crest portion 11A by the pressurized liquid L.

In this embodiment, liquid pressure of the pressurized liquid L is applied to the sealing portion 140 in a direction from the rod 130 toward the raw material tube 2, whereby the sealing portion 140 is followable to bulging of the raw material tube 2. The shape and the elastic characteristics of the sealing portion 140, the liquid pressure of the pressurized liquid L, and the moving rate of the rod 130 are appropriately set so that the upper end portion of the sealing portion 140 contacts the raw material tube 2 while the lower end portion of the sealing portion 140 contacts the rod 130, when the sealing portion 140 follows the raw material tube 2. Accordingly, as shown in FIG. 2A, at least a portion of the sealing portion 140 continuously closely contacts the raw material tube 2. As a result, even when the pressurized liquid L is continuously set at high pressure during formation of the raw material tube, leakage of the pressurized liquid to the outside in the anterior side of the forming direction is prevented.

Then, as shown in FIG. 2B, the sealing portion 140 passes a position corresponding to a third root portion 11B of the die 10 after the third crest portion 2A of the raw material tube 2 is formed. In this embodiment, the distance between the sealing portions 140 and 150 is set to have a length of at least two crest portions of the inner surface shape of the die 10. Therefore, as shown in FIG. 2B, when the sealing portion 140 passes a position corresponding to the third root portion 11B of the die 10, the sealing portion 150 passes a position corresponding to a first root portion 2B of the raw material tube 2.

The length in the axial direction of the sealing portion 150 is set to have a length of at least one crest portion of the inner surface shape of the die 10. Therefore, as shown in FIG. 2B, each end portion of the sealing portion 150 passes a position corresponding to the bottom portion at each end of the first crest portion 2A (a flat portion at the left end portion of the raw material tube 2 and the first root portion 2B of the raw material tube 2). Accordingly, by appropriately setting the shape and the elastic characteristics of the sealing portion 150, the sealing portion 150 continuously closely contacts the bottom portions at both ends of the first crest portion 2A. As a result, even when the pressurized liquid L is continuously set at high pressure during formation of the raw material tube 2, leakage of the pressurized liquid to the outside in the posterior side of the forming direction is prevented.

Next, as shown in FIG. 2C, when the first sealing portion 140 passes a position corresponding to a fourth crest portion 11A of the die 10 after the third crest portion 2A of the raw material tube 2 is formed, the raw material tube 2 is bulged according to the shape of the fourth crest portion 11A by the pressurized liquid L. In this case, since the same function as in FIG. 2A is performed at the first sealing portion 140, at least a portion of the sealing portion 140 continuously closely contacts the raw material tube 2. As a result, even when the pressurized liquid L is continuously set at high pressure during formation of the raw material tube 2, leakage of the pressurized liquid to the outside in the anterior side of the forming direction is prevented.

In the present embodiment, the above function is repeatedly performed at the sealing portions 140 and 150 during formation of N-th crest portion 2A of the raw material tube 2 and during subsequent movement to the next crest portion 11A of the die 10, whereby the sealing portions 140 and 150 continuously closely contact the raw material tube 2 during forming. Therefore, even when the pressurized liquid L is continuously set at high pressure during the formation of the raw material tube 2, leakage of the pressurized liquid L to the outside is prevented. Accordingly, supplying for a deficiency in the liquid pressure and switching of the liquid pressure between high and low are not necessary, whereby the raw material tube 2 can be formed at high pressure and at a high rate. In addition, since the pressurized liquid L is continuously maintained at high pressure, the shape fixability of the raw material tube 2 with respect to the die 10 is improved, whereby accuracy of the tube expansion is improved, and variations among products are reduced.

The pressurized liquid L is not supplied to all areas between the raw material tube 2 and the rod 130, which correspond to the inner surface shape of the die 10, but is supplied only to an area between the raw material tube 2 and the rod 130, which is sealed by the pair of the sealing portions 140 and 150. Accordingly, a fixing device for fixing the die 10 can be reduced in size, whereby the apparatus cost is reduced. Such a bulge forming method is preferably used for a thin-walled raw material tube.

Specifically, when the pressurized liquid supply opening 131A reaches the midportion of a crest portion 11A of the die 10, the movement of the rod 130 may be intermittent, and the raw material tube 2 may be formed into the shape of the crest portion 11A of the die 10, which is immediately above the pressurized liquid supply opening 131A. In this case, even when a raw material tube 2 has a large wall thickness, the raw material tube 2 is reliably formed according to the inner surface shape 11 of the die 10.

(B) Second Embodiment (1) Structure of Second Embodiment

Figure 3:
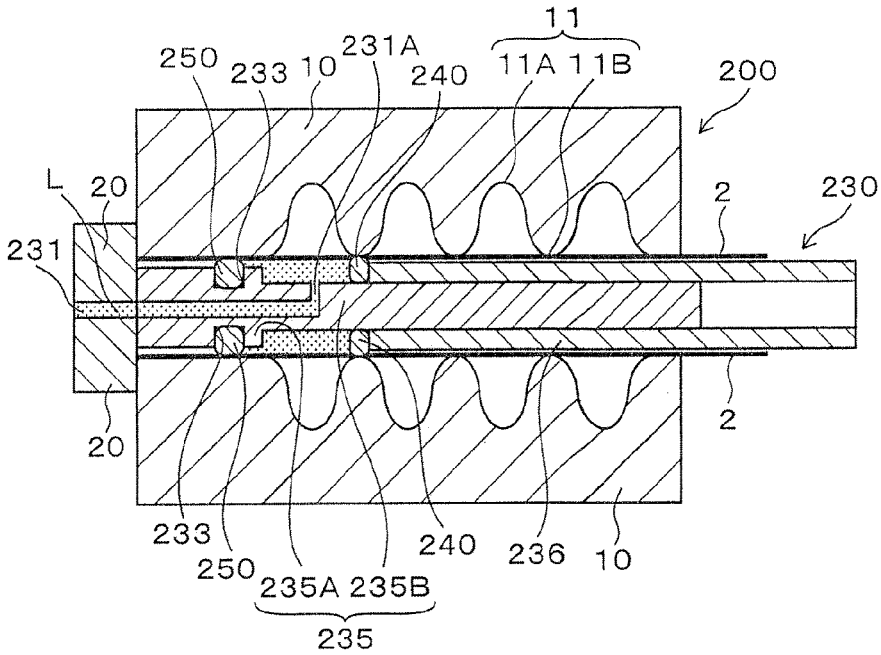
FIG. 3 is a sectional side view showing a schematic structure of a bulge forming apparatus relating to a second embodiment of the present invention.

A second embodiment of the present invention is described with reference to the drawings hereinafter. FIG. 3 is a sectional side view showing a schematic structure of a bulge forming apparatus 200 relating to the second embodiment of the present invention. In the second embodiment, structural portions similar to those in FIG. 7 are indicated by the same reference numerals as those in FIG. 7, and descriptions therefor are omitted.

A rod 230 is provided inside of the raw material tube 2 along the axial direction of the raw material tube 2. The rod 230 has a guide rod 235 to be fixed to the raw material tube 2, and has a hollow rod 236 movably arranged around the guide rod 235. The guide rod 235 has a large diameter portion 235A and a small diameter portion 235B having a smaller diameter than the diameter of the large diameter portion 235A. The large diameter portion 235A has a left end portion fixed to the abutting die 20. The small diameter portion 235B is connectedly formed with a right end portion of the large diameter portion 235A and is extended to the right in the axial direction. The hollow rod 236 is arranged between the raw material tube 2 and the small diameter portion 235B and is slidable on the small diameter portion 235B.

A pressurized liquid supply path 231 is formed inside the rod 230 and inside the abutting die 20, and a pressurized liquid L is supplied to a space between the raw material tube 2 and the rod 230 through a pressurized liquid supply opening 231A. The pressurized liquid supply opening 231A is formed at the surface of the small diameter portion 235B. In the second embodiment, collecting of the pressurized liquid L is not required in tube expansion, as described below, and a pressurized liquid collecting path need not be provided. A groove 233 is formed on the circumferential surface of the large diameter portion 235A.

A sealing portion 240 (a first sealing portion) and a sealing portion 250 (a second sealing portion) are arranged between the raw material tube 2 and the rod 230. The sealing portion 240 has a ring shape and is slidably arranged on the circumferential surface of the small diameter portion 235B. The sealing portions 240 and 250 are elastic. In the second embodiment, since the hollow rod 236 is moved to the right in forming of the raw material tube 2, the sealing portion 240 corresponds to a sealing portion in the anterior side of the forming direction, and the sealing portion 250 corresponds to a sealing portion in the posterior side of the forming direction.

The sealing portion 240 is pressed toward a left end portion of the hollow rod 236 by liquid pressure of the pressurized liquid L supplied to the space between the raw material tube 2 and the rod 230, whereby the sealing portion 240 is elastically deformed. The position of the sealing portion 240 is controlled by the movement of the hollow rod 236. Such a sealing portion 240 is compressed in the axial direction and is expanded in the vertical direction by the pressure of the pressurized liquid L, and therefore, the sealing portion 240 is followable to bulging of the raw material tube 2. In this case, the sealing portion 240 is arranged at the left end portion of the hollow rod 236, which is a start position of the bulging of the raw material tube 2, whereby the sealing portion 240 easily follows the bulging of the raw material tube 2. By appropriately setting the shape and the elastic characteristics of the sealing portion 240, the liquid pressure of the pressurized liquid L, the moving rate of the hollow rod 236, etc., at least a portion of the sealing portion 240 continuously closely contacts the raw material tube 2. The initial position of the sealing portion 240 is set by the left end portion of the hollow rod 236, and for example, the initial position is set at a position corresponding to a root portion 11B between a first crest portion 11A and a second crest portion 11A of the die 10. The sealing portion 240 may be fixed to the left end portion of the hollow rod 236 by adhering.

The sealing portion 250 has a ring shape and is secured to the groove 233. In this case, by appropriately setting the shape and the elastic characteristics of the sealing portion 250, the sealing portion 250 continuously closely contacts the flat portion of the left end portion of the raw material tube 2.

(2) Operation of Second Embodiment

A bulge forming method using the bulge forming apparatus 200 is described with reference primarily to FIG. 4.

Figure 4:
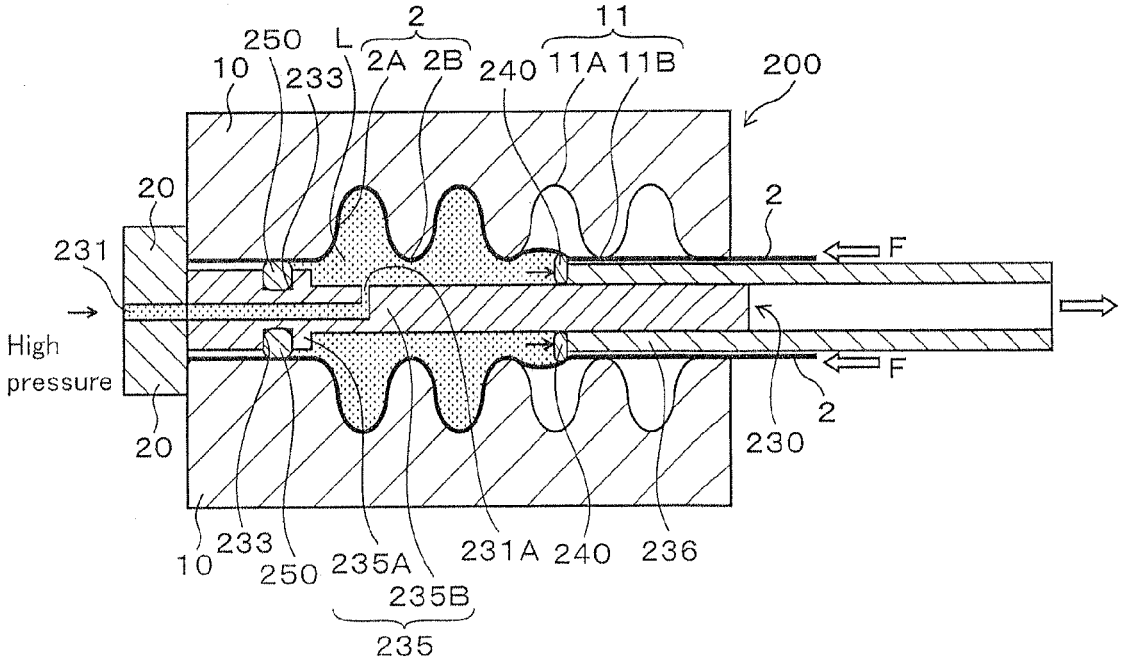
FIG. 4 is a sectional side view showing a step in a bulge forming method using the bulge forming apparatus shown in FIG. 3.

As shown in FIG. 4, a left end portion of the raw material tube 2 is butted with the abutting die 20, and the pressurized liquid L is supplied to an area from the pressurized liquid supply opening 231A into the raw material tube 2 while compressive stress F is applied from a right end portion of the raw material tube 2 toward the left in the axial direction. The area is sealed by the pair of the sealing portions 240 and 250. In this condition, the hollow rod 236 is moved to the right in the axial direction (in a direction of a wide arrow shown in FIG. 4), whereby the raw material tube 2 is bulged according to the shape of a crest portion 11A by the pressurized liquid L each time the pressurized liquid L is supplied to a position corresponding to the crest portion 11A of the die 10. Thus, crest portions 2A and root portions 2B are formed at the raw material tube 2 one by one, in order, from the posterior side of the moving direction of the hollow rod 236 (from the posterior side of the forming direction), whereby the raw material tube 2 is expanded into a shape corresponding to the bellows shape 11 of the die 10.

In such tube expansion, the sealing portion 240 is pressed toward the left end portion of the hollow rod 236 by the liquid pressure of the pressurized liquid L supplied to the space between the raw material tube 2 and the rod 230. Therefore, the sealing portion 240 is elastically deformed by the pressing power of the pressurized liquid L, whereby the sealing portion 240 is followable to bulging of the raw material tube 2. Accordingly, by appropriately setting the shape and the elastic characteristics of the sealing portion 240, the liquid pressure of the pressurized liquid L, etc., at least a portion of the sealing portion 240 continuously closely contacts the raw material tube 2.

The hollow rod 236 controls the position of the sealing portion 240 by the movement thereof, and the moving rate of the hollow rod 236 may be controlled so as to be not less than the bulging rate of the raw material tube 2. Therefore, the sealing portion 240 can be continuously moved to a start position of the bulging of the raw material tube 2 and to a position anterior to the start position in the forming direction. Accordingly, the sealing portion 240 is pressed at the left end portion of the hollow rod 236 by the liquid pressure of the above pressurized liquid L, whereby amount of elastic deformation of the sealing portion 240 is large. Thus, the sealing portion 240 easily follows the bulging of the raw material tube 2, and the contacting condition of at least a portion of the sealing portion 240 is further improved. As a result, even when the pressurized liquid L is continuously set at high pressure, leakage of the pressurized liquid L to the outside in the anterior side of the forming direction is prevented.

Since the sealing portion 250 is secured by the guide rod 235, the sealing portion 250 is positioned at the flat portion of the raw material tube 2 without changing the position and the shape thereof. Therefore, by appropriately setting the shape and the elastic characteristics of the sealing portion 250, the sealing portion 250 continuously closely contacts the flat portion of the raw material tube 2. As a result, even when the pressurized liquid L is continuously set at high pressure during formation of the raw material tube 2, leakage of the pressurized liquid L to the outside in the posterior side of the forming direction is prevented.

As described above, in the second embodiment, even when the pressurized liquid L is continuously set at high pressure during formation of the raw material tube 2, leakage of the pressurized liquid L to the outside is prevented. Accordingly, supplying for a deficiency in the liquid pressure and switching of the liquid pressure between high and low are not necessary, whereby the raw material tube 2 can be formed at high pressure and at a high rate. Since the pressurized liquid L can be continuously maintained at high pressure, the shape fixability of the raw material tube 2 with respect to the die 10 is improved, whereby accuracy of the tube expansion is improved, and variations among products are reduced.

The hollow rod 236 that moves in forming of the raw material tube 2 receives the liquid pressure from the left end portion via the sealing portion 240. Therefore, compared to a conventional case in which the entirety of the outer circumferential surface of a rod receives liquid pressure, the hollow rod 236 receives a low level of liquid pressure. Accordingly, the amount of power required for controlling the position of the hollow rod 236 can be small, whereby a moving device for the hollow rod 236 may be reduced in size. Since the pressurized liquid supply opening 231A is formed at the guide rod 235 fixed to the abutting die 20, the pressurized liquid supply path 231 to the pressurized liquid supply opening 231A is formed at the guide rod 235. Therefore, compared to a conventional case in which a pressurized liquid supply path is formed at a rod that moves in forming of a raw material tube, the pressurized liquid supply path 231 is simply constructed. According to the above descriptions, the apparatus cost is decreased.

(C) Third Embodiment

Figure 5:
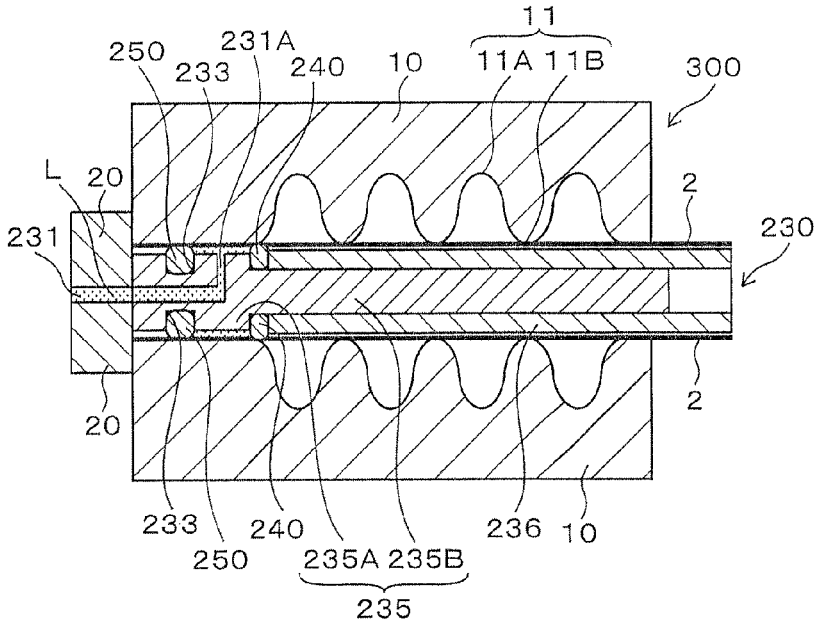
FIG. 5 is a sectional side view showing a schematic structure of a bulge forming apparatus relating to a third embodiment of the present invention.

FIG. 5 is a sectional side view showing a schematic structure of a bulge forming apparatus 300 relating to a third embodiment of the present invention. In the third embodiment, structural portions similar to those in the second embodiment are indicated by the same reference numerals as those in the second embodiment, and descriptions for structural portions having similar effects as those in the second embodiment are omitted. In the third embodiment, a pressurized liquid supply opening 231A is not formed at the surface of the small diameter portion 235B of the guide rod 235, but is instead formed at the surface of the large diameter portion 235A of the guide rod 235. Therefore, the sealing portion 240 can be butted with the right end portion of the large diameter portion 235A at the start of forming of the raw material tube 2. Accordingly, the initial position of the sealing portion 240 is easily set at the start of forming of the raw material tube.

Figure 6:
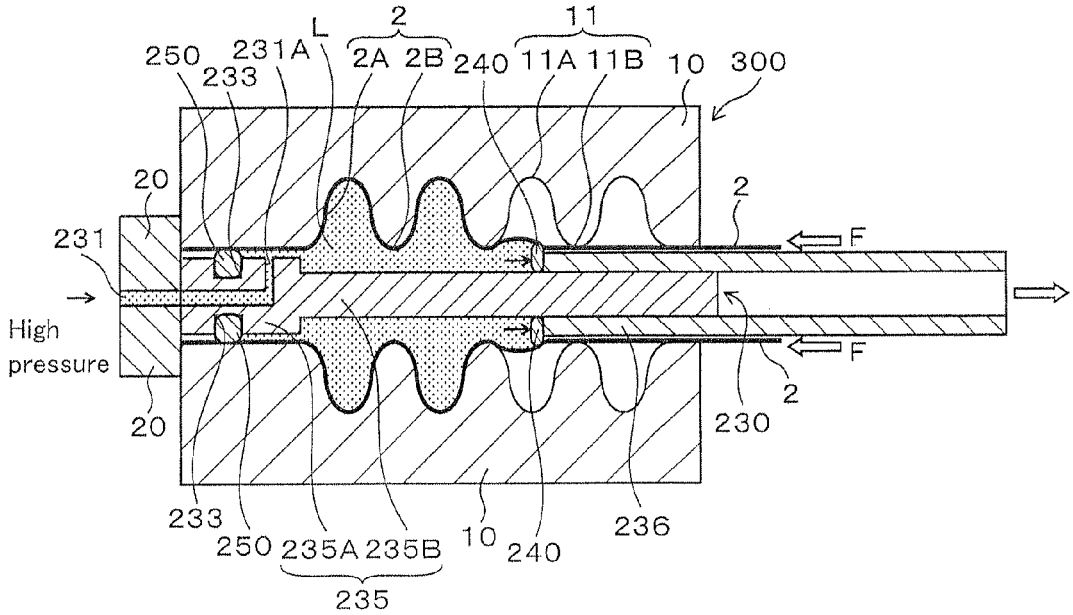
FIG. 6 is a sectional side view showing a step in a bulge forming method using the bulge forming apparatus shown in FIG. 5.

In the third embodiment, the raw material tube is formed in the same manner as in the second embodiment as shown in FIG. 6, from a condition in which the initial position of the sealing portion 240 is set as described above, whereby the same function and effects as those in the second embodiment are obtained.

What is claimed is:

1. A bulge forming method comprising:

arranging a raw material tube inside a die having an inner surface shape in which plural crest portions and root portions are alternately formed;

providing a rod inside the raw material tube in the axial direction of the raw material tube, the rod having a pressurized liquid supply opening;

providing a pair of sealing portions so as to have the pressurized liquid supply opening therebetween, the sealing portions sealing a space between the raw material tube and the rod; and moving the rod in the axial direction while applying compressive stress to the raw material tube in the axial direction and supplying a pressurized liquid from the pressurized liquid supply opening into the raw material tube, whereby the raw material tube is formed into the shape of the inner surface of the die, wherein a sealing portion is in an anterior side of a forming direction and is applied with liquid pressure of the pressurized liquid in a direction from the rod toward the raw material tube so as to be followable to bulging of the raw material tube, and wherein the distance between the sealing portions is set to have a length of at least two crest portions of the inner surface shape of the die, and a length in the axial direction of a sealing portion in a posterior side of the forming direction is set to have a length of at least one crest portion of the inner surface shape of the die.

2. The bulge forming method according to claim 1, wherein when the pressurized liquid supply opening reaches a position corresponding to the midportion of the crest portion of the die, movement of the rod is intermittent, and the raw material tube is formed into the shape of the crest portion of the die, which is immediately above the pressurized liquid supply opening.

3. A bulge forming apparatus comprising:

a die having an inner surface shape, in which plural crest portions and root portions are alternately formed, the die formed so that a raw material tube is arranged inside thereof;

a rod provided inside the raw material tube along the axial direction of the raw material tube and having a pressurized liquid supply opening; and a pair of sealing portions provided so as to have the pressurized liquid supply opening therebetween and sealing a space between the raw material tube and the rod, wherein the rod is moved in the axial direction while compressive stress is applied to the raw material tube in the axial direction and a pressurized liquid is supplied from the pressurized liquid supply opening into the raw material tube, whereby the raw material tube is formed into the shape of the inner surface of the die, wherein the rod is provided with a liquid pressure applying path for applying liquid pressure of the pressurized liquid to a sealing portion in an anterior side of a forming direction, in a direction from the rod toward the raw material tube, and the sealing portion in the anterior side of the forming direction is followable to bulging of the raw material tube by the liquid pressure of the pressurized liquid applied through the liquid pressure applying path, and wherein the distance between the sealing portions is set to have a length of at least two crest portions of the inner surface shape of the die, and a length in the axial direction of a sealing portion in a posterior side of the forming direction is set to have a length of at least one crest portion of the inner surface shape of the die.

4. The bulge forming apparatus according to claim 3, wherein when the pressurized liquid supply opening reaches a position corresponding to the midportion of the crest portion of the die, the movement of the rod is intermittent, and the raw material tube is formed into the shape of the crest portion of the die, which is immediately above the pressurized liquid supply opening.

5. A bulge forming method comprising:

arranging a raw material tube inside a die having an inner surface shape in which plural crest portions and root portions are alternately formed;

forming a rod so as to have a guide rod and a hollow rod, the guide rod fixed to the die and having a pressurized liquid supply opening, and the hollow rod movably arranged around the guide rod;

providing the rod inside the raw material tube;

providing a pair of a first sealing portion and a second sealing portion so as to have the pressurized liquid supply opening therebetween, the first and the second sealing portions sealing a space between the raw material tube and the rod, the first sealing portion arranged so that the guide rod guides the first sealing portion along the axial direction of the raw material tube, and the second sealing portion secured to the guide rod; and moving the hollow rod in the axial direction while applying compressive stress to the raw material tube in the axial direction and supplying a pressurized liquid from the pressurized liquid supply opening into the raw material tube, whereby the raw material tube is formed into the shape of the inner surface of the die, and wherein the hollow rod has an end portion in a posterior side of a forming direction, the first sealing portion is pressed toward the end portion by liquid pressure of the pressurized liquid and is elastically deformed so as to be followable to bulging of the raw material tube, and the position of the second sealing portion is controlled by the movement the hollow rod, in the forming of the raw material tube.

6. The bulge forming method according to claim 5, wherein the guide rod is formed so as to have a large diameter portion and a small diameter portion that is connected to the large diameter portion and has a smaller diameter than the diameter of the large diameter portion, the second sealing portion secured to the large diameter portion, the small diameter portion guides the first sealing portion in the axial direction of the raw material tube, the hollow rod is movably arranged around the small diameter portion, and the pressurized liquid supply opening is formed at the large diameter portion.

7. A bulge forming apparatus comprising:

a die having an inner surface shape, in which plural crest portions and root portions are alternately formed, the die formed so that a raw material tube is arranged inside thereof;

a rod provided inside the raw material tube; and a pair of a first sealing portion and a second sealing portion provided so as to have a pressurized liquid supply opening therebetween, the first and the second sealing portion sealing a space between the raw material tube and the rod, wherein the rod is formed so as to have a guide rod and a hollow rod, the guide rod is fixed to the die and has the pressurized liquid supply opening, and the hollow rod is movably arranged around the guide rod, wherein the first sealing portion is arranged so that the guide rod guides the first sealing portion along the axial direction of the raw material tube, and the second sealing portion is secured to the guide rod, wherein the hollow rod is moved in the axial direction while compressive stress is applied to the raw material tube in the axial direction of the raw material tube and a pressurized liquid is supplied from the pressurized liquid supply opening into the raw material tube, whereby the raw material tube is formed into the shape of the inner surface of the die, and wherein the hollow rod has an end portion in a posterior side of a forming direction, the first sealing portion is pressed toward the end portion by liquid pressure of the pressurized liquid and is elastically deformed so as to be followable to bulging of the raw material tube, and the position of the second sealing portion is controlled by the movement of the hollow rod, in the forming of the raw material tube.

8. The bugle forming apparatus according to claim 7, wherein the guide rod is formed so as to have a large diameter portion and a small diameter portion that is connected to the large diameter portion and has a smaller diameter than the diameter of the large diameter portion, the second sealing portion secured to the large diameter portion, the small diameter portion guides the first sealing portion in the axial direction of the raw material tube, the hollow rod is movably arranged around the small diameter portion, and the pressurized liquid supply opening is formed at the large diameter portion.

* * * * *